US005730893A

United States Patent [19]

Wyman et al.

[11] Patent Number: 5,730,893

[45] Date of Patent: Mar. 24, 1998

[54] MAGNETIC COLLOIDS USING ACID TERMINATED POLY (12-HYDROXYSTEARIC ACID) DISPERSANTS

[75] Inventors: John E. Wyman, Westford, Mass.; Shiro Tsuda, Chiba, Japan

[73] Assignee: Ferrotec Corporation, Tokyo, Japan

[21] Appl. No.: 753,908

[22] Filed: Dec. 3, 1996

Related U.S. Application Data

[63] Continuation-in-part of Ser. No. 669,130, Jun. 24, 1996, abandoned, which is a continuation-in-part of Ser. No. 636,753, Apr. 19, 1996, abandoned.

[51] Int. Cl.[6] ..... H01F 1/44

[52] U.S. Cl. ..... 252/62.52; 252/62.54

[58] Field of Search ..... 252/62.52, 62.54

[56] References Cited

U.S. PATENT DOCUMENTS

| | | | |
|---|---|---|---|
| 2,106,882 | 2/1938 | Bets et al. | 175/183 |
| 2,751,352 | 6/1956 | Bondi et al. | 252/62.52 |
| 2,859,181 | 11/1958 | Jordan et al. | 252/62.52 |
| 4,208,294 | 6/1980 | Khalafalla et al. | 252/62.52 |
| 4,430,239 | 2/1984 | Wyman | 252/62.52 |
| 4,548,873 | 10/1985 | Yamamoto et al. | 428/695 |
| 4,554,220 | 11/1985 | Yamamoto et al. | 428/694 |
| 4,604,222 | 8/1986 | Borduz et al. | 252/62.52 |
| 4,701,276 | 10/1987 | Wyman | 252/62.52 |
| 4,713,293 | 12/1987 | Asano et al. | 428/403 |
| 4,938,886 | 7/1990 | Lindsten et al. | 252/62.51 |
| 5,064,550 | 11/1991 | Wyman | 252/62.52 |
| 5,271,857 | 12/1993 | Ino et al. | 252/62.54 |
| 5,487,840 | 1/1996 | Yabe et al. | 252/62.52 |

FOREIGN PATENT DOCUMENTS 53-31472 4/1977 Japan .

OTHER PUBLICATIONS

D.J. Walbridge, The Design and Synthesis of Dispersants for Dispersion Polymerization in Organic Media, in Dispersion Polymerization in Organic Media, 45, 60–63, 108 (K.E.J. Barrett ed., 1975) no month.

*Primary Examiner*—Melissa Bonner

*Attorney, Agent, or Firm*—Finnegan, Henderson, Farabow, Garrett & Dunner

[57] ABSTRACT

A novel magnetic colloid composition containing a polar ester carrier liquid, magnetic particles, and an acid terminated poly (12-hydroxystearic acid) dispersant of the Formula I:

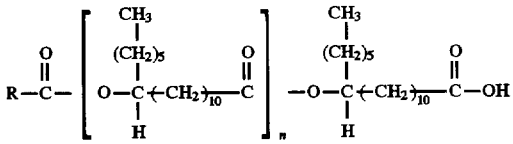

where "R" is selected from the group consisting of alkyls, aralkyls, and aryls, substituted or unsubstituted, and "n" is an integer from 0 to 4, or mixtures thereof where "R" and "n" may be the same or different.

45 Claims, No Drawings

MAGNETIC COLLOIDS USING ACID TERMINATED POLY (12-HYDROXYSTEARIC ACID) DISPERSANTS

This application is a continuation-in-part of application Ser. No. 08/669,130 filed Jun. 24, 1996, now abandoned, which is a continuation-in-part of application Ser. No. 08/636,753 filed Apr. 19, 1996, now abandoned.

BACKGROUND OF THE INVENTION

The present invention relates to novel magnetic colloid compositions using a single type of dispersant, namely an acid terminated poly (12-hydroxystearic acid). The magnetic colloid compositions of the present invention also have improved oxidation resistance.

Super paramagnetic fluids, commonly referred to as ferrofluids, are colloidal suspensions of magnetic particles suspended in a carrier liquid. The magnetic particles are suspended in the carrier liquid by a dispersing agent which attaches to the surface of the magnetic particles to physically separate the particles from each other. Dispersing agents, or dispersants, are molecules which have a polar "head" or anchor group which attaches to the magnetic particle and a "tail" which extends outwardly from the particle surface and is dissolved by the carrier liquid.

Magnetic fluids have a wide variety of industrial and scientific applications which are known to those skilled in the art. Magnetic fluids can be positioned and held in space, without a container, by a magnetic field. This unique property has led to the use of magnetic fluids in liquid seals which have low drag torque and which do not generate particles during dynamic operation, as conventional lip seals are wont to do. Specific uses of magnetic fluids which illustrate the present invention and its advantages include the use of magnetic liquids as components of exclusion seals for computer disk drives, seals and lubricants for bearings, for pressure and vacuum sealing devices, for heat transfer and damping fluids in audio speaker devices and for inertia damping.

In many sealing applications which use a magnetic colloid sealing system, it is particularly advantageous to have a magnetic colloid with the lowest possible viscosity to reduce frictional heating. This, in turn, reduces the temperature of the fluid in the seal and consequently the evaporation rate of the carrier liquid, thereby prolonging the life of the seal. Ideally, magnetic fluids suitable, for example, for sealing disk drives for computers have both a low viscosity and a low evaporation rate.

These two physical characteristics of magnetic fluids are primarily determined by the physical and chemical characteristics of the carrier liquid. However, the viscosity of a magnetic colloid can be affected by the choice of dispersant.

According to the Einstein relationship, the viscosity of an ideal colloid is:

$$(N/N_O)=1+\alpha\Phi$$

wherein

N is the colloid viscosity;

$N_O$ is the carrier liquid viscosity;

$\alpha$ is a constant; and $\Phi$ is the disperse phase volume.

The saturation magnetization of magnetic fluids is a function of the disperse phase volume of magnetic material in the magnetic fluid. In magnetic fluids, however, the actual disperse phase volume is equal to the phase volume of magnetic particles plus the phase volume of the attached dispersant. The greater the phase volume of the dispersant, the greater the total disperse phase volume at any given magnetization value of a magnetic liquid. This results in a higher colloid viscosity which could lead to higher colloid temperature under operating conditions of a dynamic seal. This could result in a lowered seal life.

In other applications, however, such as in inertia damping, a high viscosity colloid is desirable.

Although there are many devices in use today which make use of the unique properties of magnetic colloids, there are nonetheless certain disadvantages to the prior art magnetic colloids. The majority of commercially viable magnetic colloids use at least two dispersants to form stable colloids. Moreover, in colloidal systems utilizing as a carrier liquid a polar ester liquid, at least two dispersants are generally also used or preferred. See U.S. Pat. No. 4,938,886, which is incorporated by reference in its entirety. The use of multiple dispersants in magnetic colloids, however, causes the system to become overly complex and adds unnecessary and unwanted steps and costs to the preparation of the magnetic colloids. Also, colloids in which one of the dispersants is a fatty acid such as oleic, linoleic, or isostearic acid, are susceptible to oxidative degradation of the dispersant system which results in gellation of the magnetic colloid.

SUMMARY OF THE INVENTION

Accordingly, the present invention is directed to novel magnetic colloids using acid terminated poly (12-hydroxystearic acid) dispersants as the sole dispersant in a polar ester carrier liquid. Additional features and advantages of the invention will be set forth in the description which follows, and in part will be apparent from the description or may be learned from practice of the invention. The advantages of the invention will be realized and attained by the composition particularly pointed out in the written description and claims.

To achieve these and other advantages and in accordance with the purpose of the invention, as embodied and broadly described, the invention provides a magnetic colloid composition comprising a polar ester carrier liquid, magnetic particles, and a dispersant selected from the group consisting of acid terminated poly (12-hydroxystearic acid) dispersants of the Formula I:

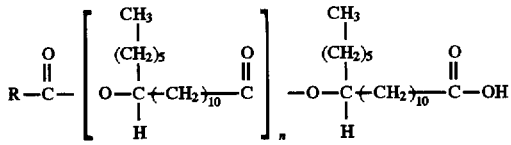

where "R" is selected from the group consisting of alkyls, aralkyls, and aryls, substituted or unsubstituted, and "n" is an integer from 0 to 4, or mixtures thereof where "R" and "n" may be the same or different.

There is also provided a stable magnetic colloid composition having improved resistance to oxidative degradation, consisting essentially of a polar ester carrier liquid, magnetic particles, and a dispersant selected from the group consisting of acid terminated poly (12-hydroxystearic acid) dispersants of the Formula I, or mixtures thereof.

It is to be understood that both the foregoing general description and the following detailed description are exemplary and explanatory and are intended to provide further explanation of the invention as claimed.

DETAILED DESCRIPTION OF THE INVENTION

The present invention is directed to a novel magnetic colloid composition. In particular, the present invention is directed to a magnetic colloid composition having a polar ester carrier liquid, magnetic particles, and a dispersant having the Formula I:

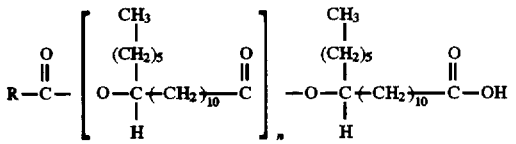

where "R" is selected from the group consisting of alkyls, aralkyls, and aryls, substituted or unsubstituted, and "n" is an integer from 0 to 4, or mixtures thereof where "R" and "n" may be the same or different.

Ferrofluids (magnetic colloids) and methods of making ferrofluids are generally well-known in the art. U.S. Pat. No. 4,701,276, which is incorporated here in its entirety by reference, describes ferrofluids and their uses and applications. Ferrofluids generally comprise a carrier liquid and magnetic particles in a stable colloidal suspension in the carrier liquid.

It was discovered by the present inventor that acid terminated poly (12-hydroxystearic acid) dispersants having the Formula I above surprisingly and unexpectedly produced an excellent dispersion of magnetic particles in a polar ester carrier liquid without the need for a second dispersant. It is known from D. J. Walbridge, *The Design and Synthesis of Dispersants for Dispersion Polymerization in Organic Media*, in Dispersion Polymerization in Organic Media, 45, 60–63 (K. E. J. Barrett ed., 1975) that an acid terminated poly (12-hydroxystearic acid) has been used as a dispersant in a low boiling hydrocarbon carrier liquid. Based on this, it was not expected that the acid terminated poly (12-hydroxystearic acid) could be used as a dispersant for magnetic particles in a polar ester carrier liquid. Not only does acid terminated poly (12-hydroxystearic acid) disperse magnetic particles in a polar ester carrier liquid, it does so in such a way that a second dispersant is neither required nor desired. Moreover, the use of acid terminated poly (12-hydroxystearic acid) to disperse magnetic particles in a polar ester carrier liquid results in a magnetic colloid having improved resistance to oxidative degradation.

The carrier liquid used in the magnetic colloid of the present invention may be any polar ester carrier liquid known by those skilled in the art to be useful for magnetic colloids. The choice of polar ester carrier liquid and amount employed is dependent upon the intended application of the magnetic colloid and can be readily determined based upon the particular desired characteristics of the final colloid. Suitable polar ester carrier liquids are disclosed in U.S. Pat. No. 4,938,886 which is incorporated herein in its entirety by reference.

Examples of polar carrier liquids in which stable suspensions of magnetic particles may be formed according to the present invention include any of the ester plasticizers for polymers such as vinyl chloride resins. Such compounds are readily available from commercial sources. Suitable polar ester carrier liquids include: polyesters of saturated hydrocarbon acids, such as $C_6$–$C_{12}$ hydrocarbon acids; phthalates, such as dioctyl and other dialkyl phthalates; citrate esters; and trimellitate esters, such as tri (n-octyl/n-decyl) esters. Other suitable polar ester carriers include: esters of phthalic acid derivatives, such as dialkyl and alkybenzyl orthophthalates; phosphates, such as triaryl, trialkyl or alkylaryl phosphates; and epoxy derivatives, such as epoxidized soybean oil.

Preferably, the polar ester carrier liquid used in the present invention is a trimellitate ester. More preferably, the carrier liquid is a trimellitate triester, which are widely used as plasticizers in the wire and cable industry. The preferred trimellitate triester, for example, is available from Aristech Chemical Company under the trade name PX336.

The ferrofluids according to the present invention may contain any magnetic particle suitable for use in ferrofluids, including metal particles and metal alloy particles. Suitable magnetic particles for use in the present ferrofluid include magnetite, gamma iron oxide, chromium dioxide, ferrites, including MnZn ferrites, and various metallic alloys. Preferably, the magnetic particles are magnetite ($Fe_3O_4$) or gamma iron oxide ($FeO_3$). More preferably, the magnetic particles are magnetite. Procedures for making magnetite and other suitable magnetic particles are readily known to those in the art.

The amount of magnetic particle employed in the inventive ferrofluid is dependant upon the intended use of the ferrofluid and the optimal amount can be readily determined. Preferably, the amount of magnetic particles is from about 1% to about 20% by volume of the ferrofluid. More preferably, the amount of magnetic particles is from about 1% to about 10% by volume of the fluid, most preferably from about 3% to about 5% by volume of the fluid.

Magnetic particles, such as magnetite, in the ferrofluid preferably have an average magnetic particle diameter of between 80 Å and 90 Å, although particles having a larger or smaller magnetic particle diameter may be used as appropriate. The appropriate particle size may be readily determined based upon the intended application of the ferrofluid.

According to the invention, the magnetic particles used in the present magnetic colloid are coated with an acid terminated poly (12-hydroxystearic acid) having the general Formula I, or mixtures thereof, to form stable colloidal suspensions of the magnetic particles in the disclosed polar ester carrier liquids.

In Formula I, "R" is selected from the group consisting of alkyls, aralkyls, and aryls, substituted or unsubstituted, and "n" is an integer from 0 to 4. Preferably, "R" is a $C_{22}$ or less substituted or unsubstituted alkyl and "n" is an integer from 0 to 3. More preferably, "R" is a $C_{17}$ or less linear or branched alkyl and "n" is an integer from 0 to 2.

The acid terminated poly (12-hydroxystearic acid) is produced, for example, by the condensation polymerization of 12-hydroxystearic acid and a monobasic organic acid such as behenic acid, arachidic acid, stearic acid, oleic acid, linoleic acid, palmitic acid, lauric acid, 2-ethyl hexanoic acid, benzoic acid, p-toluic acid, and the like. A poly (12-hydroxystearic acid) dispersant terminated with isostearic acid, and produced as indicated above, has been found to be an effective dispersant for the present invention. In a preferred embodiment, the acid terminated poly (12-hydroxystearic acid) dispersant has a molecular weight of about 500 to 1500.

In accordance with the present invention, the acid terminated poly (12-hydroxystearic acid) effectively disperses magnetic particles in a polar ester carrier liquid without the use of a second dispersant, and results in a highly stable magnetic colloid having excellent resistance to oxidative degradation.

Although not required by the present invention, additional additives such as antioxidants and quarternary ammonium salts may be added to the magnetic colloid composition.

With respect to the use of antioxidants, the antioxidant may be any antioxidant known to those skilled in the art, including aromatic amines, hindered phenols and sulfur-containing compounds. One skilled in the art may readily ascertain the amount and suitability of a given antioxidant simply by adding the antioxidant to the magnetic colloid and seeing if the gelation time of the colloid is increased relative to that of the colloid without the antioxidant. In a preferred embodiment where the acid terminated poly (12-hydroxystearic acid) dispersant has a molecular weight of about 500 to 1500, the magnetic colloid composition preferably has a gel time measured at 130° C. of about 230 to 750 hours. An example of an antioxidant useful in the present invention is an alkylaryl amine, more specifically the alkyldiphenylamine "L-57" available from Ciba-Geigy.

Quaternary ammonium salts may be added to the magnetic colloid composition of the present invention to improve the electrical conductivity of the colloid. The amount and type of the quarternary ammonium salt added is readily determined and may be added up to the saturation point of the composition to achieve the maximum conductivity. Examples of the quarternary ammonium salts useful in the present invention include "EMCOL CC-9" and "EMCOL CC-55" which are available from the Witco Corp.

In a preferred embodiment where the acid terminated poly (12-hydroxystearic acid) dispersant has a molecular weight of about 500 to 1500, the magnetic colloid composition preferably has a viscosity measured at 27° C. of about 80 to 570 cP.

The following examples are merely illustrative of the invention and should not be construed as limiting. One skilled in the art can make, without undue experimentation, various substitutions and variations and by equivalent means, performing in substantially the same manner, obtain substantially the same results without departing from the teaching and spirit of the invention.

EXAMPLE 1

Preparation of Acid Terminated Poly (12-hydroxystearic acid) Dispersant

The general procedure described below was used to prepare the dispersants.

A three necked round bottom flask placed in a heating mantel was equipped with a mechanical stirrer, a Dean-Stark trap filled with xylene and topped by a condenser, and a glass tube through which an inert gas such as nitrogen or argon is introduced to blanket the reaction mixture. The organic acids are introduced into the flask with a quantity of xylene equal to 10% of the weight of the organic acids and the inert gas flow is started, the mixture is heated, and when the organic acids have melted the stirrer is started. Heating and stirring the mixture is continued until water is no longer collected in the Dean-Stark trap. The solution of the dispersant is then allowed to cool under an inert gas blanket. D. J. Walbridge, supra, 108.

EXAMPLE 2

Titration Method To Determine Molecular Weight

A 1.3–2.0 gram quantity of the dispersant solution prepared according to Example 1 is added to 25 g. of absolute ethanol, and 5 drops of a phenolphthalein indicator solution are added. The mixture is stirred continuously while the solution is titrated to a phenolphthalein end point with 0.1 molar sodium hydroxide. The molecular weight may then be determined knowing the amount of sodium hydroxide used. Measurement of molecular weight permits the determination of the extent of polymerization of the reaction mixture.

Preparation of Magnetic Colloids

EXAMPLE 3

Utilizing the general procedure and apparatus described above, a dispersant was prepared from 700 g. of technical grade 12-hydroxystearic acid [80–90% 12-hydroxystearic acid, remainder monobasic fatty acid] and 70 g. xylene. A total quantity of 35 ml. of water was recovered from the Dean-Stark trap. The molecular weight of the dispersant was found to be about 1537 as determined by the titration method described above, thus indicating that an acid terminated poly (12-hydroxystearic acid) had been produced.

A slurry of magnetite was prepared by adding a solution of 69.5 g. of ferrous sulfate heptahydrate and 117.5 cc of 42° Be ferric chloride solution in 100 ml of water to a vigorously stirred mixture of 100 ml of water and 150 ml of 26° Be ammonia solution. The mixture was stirred and heated to 60–70° C. to complete the formation of magnetite.

A quantity of 83 g. of the dispersant solution was added to the magnetite slurry with stirring, and an additional 300 ml of xylene was added. The aqueous solution of byproduct ammonium salts was decanted and the coated magnetite was washed several times with water by decantation. The xylene slurry was heated to evaporate residual water and xylene, and following the addition of about 60 ml of PX-336 (polar ester carrier liquid), the slurry was further heated to remove residual xylene.

The magnetic colloid was refined over a magnet in a 60° C. oven to remove unstable particles from the colloid, and the refined fluid was filtered to remove residual ammonium salts. The colloid stability of the filtered colloid was determined by allowing a small quantity in an aluminum dish to stand over a samarium/cobalt magnet in a 60° C. oven for 24 hours. There was no evidence of separation of the PX-336 carrier liquid. The pan was removed from the samarium/cobalt magnet and the high viscosity liquid was quickly poured off. There was only a very slight separation of particles from the colloid as shown by the very small ring of solid remaining in the area corresponding to the area of greatest magnetic field gradient.

EXAMPLE 4

An acid terminated poly (12-hydroxystearic acid) dispersant was prepared from 415 g. of technical grade 12-hydroxystearic acid, 80–85% purity, 85 g. of isostearic acid, and 50 g. of xylene. The apparatus and procedure described in Example 1 was used, and 20 ml. of water was collected.

A slurry of magnetite was prepared as described in Example 3, and a solution of 60 g. of the dispersant solution in 100 ml. of heptane was added to the magnetite slurry and stirred for one hour. The coated magnetite was collected around a magnet and the supernatant aqueous salt solution was decanted. The coated magnetite was washed with water, then with three 500 ml. portions of acetone. Additional heptane was added, and the slurry was heated to an internal temperature of 95° C. to boil out residual water and acetone.

The heptane slurry was cooled and placed in an aluminum pan over an Alnico 5 magnet for one hour, then the slurry was filtered. Without moving the pan from the magnet, the pan was washed with heptane by decantation until all the magnetite which would go into stable suspension in heptane was removed.

Heptane was evaporated from the filtered slurry, and about 70 ml. of PX-336 was added and the resulting colloid was heated in a stream of air to remove the heptane. The colloid was refined over a samarium/cobalt magnet in a 60° C. oven for three days and filtered.

The colloid had a density of 1.24 g/cc, an apparent magnetization of 317 gauss, and a viscosity of 1179 cp. at 27° C.

EXAMPLE 5

An acid terminated poly (12-hydroxystearic acid) dispersant was prepared from 454.5 g. of technical grade 12-hydroxystearic acid, 80–85% purity, 45.5 g. 2-ethylhexanoic acid, and 50 g. of xylene. The apparatus and procedure described in Example 1 was used, and 25 ml. of water was recovered.

A slurry of magnetite was prepared as described in Example 3, and 60 g. of the dispersant solution described above was added and the mixture was stirred for about one hour. The coated magnetite was washed with water by decantation and then washed with acetone as described in Example 4. The coated magnetite was suspended in heptane and the slurry was heated to an internal temperature of 95° C. to evaporate residual water and acetone.

The heptane slurry was cooled and refined over an Alnico magnet and filtered as described in Example 4.

As heptane was evaporated from the slurry by heating, a total of 70 cc. of PX-336 was added and the residual heptane was removed by evaporation. The colloid was refined over a samarium/cobalt magnet in a 60° C. oven for 24 hours, then filtered. A stable colloid with a density of 1.301 g/cc., an apparent magnetization of 389 gauss, and a viscosity of 1275 cp at 27° C. was obtained.

EXAMPLE 6

An acid terminated poly (12-hydroxystearic acid) dispersant was prepared from 250 g. of technical grade 12-hydroxystearic acid, 80–85% purity, 60 g. of behenic acid, and 31 g. of xylene. The procedure and apparatus described in Example 1 was used, and 12 cc. of water was collected.

A magnetite slurry was prepared as described in Example 3, and 64 g. of the dispersant solution described above was added with stirring. An additional 20 ml. of heptane was added and stirring was continued for one-half hour. The mixture was now mostly emulsified, but it was diluted and washed as well as possible with three portions of water, each equal in volume to the original emulsion.

The slurry was washed three times with equal volume portions of acetone. The acetone washed slurry was transferred to a 500 ml. three neck flask on a heating mantle and equipped with a Dean-Stark trap topped by a reflux condenser, a thermometer, and a tube dipping below the surface of the liquid through which argon was passed. Approximately 200 ml. of xylene was added, and the slurry was heated to remove acetone, heptane, and water. When no additional water was coming from the slurry, it was cooled and poured into an aluminum pan over an Alnico 5 magnet and refined for one hour. The refined slurry was filtered as described in Example 4.

The slurry was evaporated to reduce the volume, and 50 cc. of PX-336 was added and evaporation was continued to remove the residual xylene. The colloid was refined over a samarium/cobalt magnet in a 60° C. oven overnight and filtered. It was diluted further with PX-336 to a density of 1.177 g/cc. and it had a viscosity of 510 cp. at 27° C.

EXAMPLE 7

An acid terminated poly (12-hydroxystearic acid) dispersant was prepared from 300 g. of 12-hydroxystearic acid, technical grade 80–85% purity, 79 g. of stearic acid, and 38 g. of xylene. The apparatus and procedure described in Example 1 was used. A total of 15.7 ml. of water was collected.

A magnetite slurry was prepared as described in Example 3, and 71 g. of the above described dispersant solution and about 20 ml. of heptane was added with stirring. Stirring was continued for one-half hour. The coated magnetite was washed three times with cold water and three times with acetone. The acetone washed slurry was then transferred to the apparatus described in Example 6 and about 200 ml. of xylene was added. The slurry was heated to remove acetone and water. When water was no longer being removed, the slurry was cooled and refined in a pan over an Alnico 5 magnet as described in Example 4.

The filtered slurry was heated to partially remove heptane and xylene, and 50 ml. of PX-336 was added and heating was continued in a stream of air to remove heptane and xylene. The colloid was refined overnight in a 60° C. oven over a samarium/cobalt magnet and filtered. A stable magnetic colloid was obtained.

EXAMPLE 8

An acid terminated poly (12-hydroxystearic acid) dispersant was prepared using 300 g. of technical grade 12-hydroxystearic acid, 80–85% purity, 44 g. of isostearic acid, and 35 g. of xylene. The apparatus and procedure described in Example 1 was used, and 13.5 cc. of water was recovered.

A slurry of magnetite was prepared as described in Example 3, and a solution of 35 ml. of heptane and 77 g. of the dispersant prepared above was added with stirring. The coated magnetite was washed four times with water and twice with 500 ml. portions of acetone.

The washed slurry was transferred with 200 ml. of xylene to the apparatus described in Example 6, and heating was continued until acetone, water, and heptane was removed and the volume was reduced to about 150 cc. The flask was rinsed with heptane and the combined heptane/xylene slurry was filtered through diatomaceous earth and then refined over an Alnico 5 magnet for one hour. The refined slurry was filtered and rinsed with heptane as described in Example 4.

The heptane and xylene solvents were partially evaporated, and 40 ml. of PX-336 was added and the residual heptane and xylene was evaporated. The colloid was refined overnight at 60° C. over a samarium/cobalt magnet and then filtered. The colloid had a density of 1.249 g/cc. and a viscosity of 942 cp. at 27° C.

EXAMPLE 9

An acid terminated poly (12-hydroxystearic acid) dispersant was prepared from 300 g. of 12-hydroxystearic acid, 51 g. of isostearic acid, and 35 g. of xylene. The apparatus and procedure described in Example 1 was used, and 14.5 ml. of water was collected.

A magnetic slurry was prepared as described in Example 3, and 77 g. of the dispersant solution described above and 40 ml. of heptane were added. After 15 minutes of stirring the pasty mass of coated magnetite was washed three times with water, then twice with 500 cc. portions of acetone. The washed magnetite was placed in the apparatus described in Example 6, and about 200 ml. of heptane was added. The slurry was heated to remove residual acetone and water. The heptane slurry was cooled, then refined for one hour over an Alnico 5 magnet. The slurry was filtered, and then heated to evaporate some of the heptane. A quantity of 40 ml. of PX-336 was added and heated to evaporate the remaining heptane and xylene. The colloid was refined overnight at 60° C. over a samarium cobalt magnet. It had a density of 1.176 g/cc. and a viscosity of 1553 cp. at 27° C.

EXAMPLE 10

A magnetic colloid was prepared utilizing an acid terminated poly (12-hydroxystearic acid) diapersant, magnetite, and PX-336. The colloid also contained 5 weight percent "Irganox L-57" antioxidant. The colloid had no measurable electrical conductivity at 50° C. (0.000 μmohs).

A quantity of "EMCOL CC-55," a polypropoxy quaternary ammonium acetate obtained from Witco Corporation, amounting to 8% by weight was added to the above described colloid. The material was completely soluble in the colloid, and caused the electrical conductivity to increase to 0.047 μmohs at 50° C.

Although preferred embodiments of the invention are described herein in detail, it will be understood by those skilled in the art that variations may be made thereto without departing from the spirit of the invention or the scope of the appended claims.

EXAMPLE 11

A solution of 35 g of ferrous sulfate heptahydrate, 59 ml of 42° Be ferric chloride, and 50 ml of water was added with stirring to a mixture of 50 ml of water and 75 ml of 26° Be ammonia. The slurry was heated with stirring to about 70° C. to complete the conversion of the mixture of iron hydroxides to magnetite.

A quantity of 44 g of the dispersant solution and 50 ml of heptane was added to the magnetite slurry and stirred for 30 minutes. 100 ml of acetone was then added and stirred to break the resulting emulsion. The coated magnetite was collected at the side of the beaker by holding an Alnico 5 magnet on the outside of the beaker. The aqueous acetone salt solution was poured off and the coated magnetite was washed four times with 300 ml portions of water. It was then washed twice with 250 ml portions of acetone to remove the water.

The washed and dried coated magnetite was then transferred to a 600 ml beaker and the reaction beaker was washed with a total quantity of 400 ml of heptane. The heptane slurry was heated in a stream of air to an internal temperature of about 96° C. to evaporate acetone and residual water.

The heptane slurry was refined in a pan over an Alnico 5 magnet for one hour, and then the heptane slurry of coated magnetite was poured off and filtered through diatomaceous earth into a 600 ml beaker without moving the pan from the magnet. The residue over the magnet was washed (without moving the pan from the magnet) with small quantities of heptane to collect all the coated magnetite which would go into stable suspension in heptane.

A total of 40 g of PX-336 was added and the slurry was heated in a stream of air to evaporate heptane. The resulting magnetic colloid was placed in a shallow aluminum pan and refined by placing the pan over a samarium/cobalt magnet in a 60° C. oven overnight. The pan was then removed from the magnet and the liquid was quickly poured off from any residue and filtered. The colloid had an apparent magnetization value of 240 gauss, a viscosity of 4382 cp. at 27° C., and a density of 1.220 g/cc.

EXAMPLE 12

An acid terminated poly (12-hydroxystearic acid) dispersant was prepared from 400 g of technical grade 12-hydroxystearic acid, 55.4 g of 2,4-dichlorobenzoic acid, and 90 g of xylene using the apparatus and procedure described in Example 1. The dispersant solution solidified to a paste when cooled to room temperature but it became a homogeneous liquid again when it was heated to about 50° C. A total of 18.5 g of water was recovered.

A slurry of magnetite was prepared and coated with 45.5 g of the above described dispersant, refined, and filtered using the procedure described in Example 11. A quantity of 40 g of PX-336 was added to the heptane slurry and it was then heated to evaporate the heptane. The resulting colloid, after refining and filtering as described in Example 11, had an apparent magnetization value of 240 gauss, a viscosity greater than 6540 cp at 27° C., and a density of 1.191 g/cc.

EXAMPLE 13

An acid terminated poly (12-hydroxystearic acid) dispersant was prepared from 400 g of commercial grade 12-hydroxystearic acid, 80–85% pure, 51.7 g of p-tert. butyl benzoic acid, and 90 g of xylene. The apparatus and procedure described in Example 1 was used, and a total of 18 g of water was recovered. The dispersant solution solidified to a paste when it was cooled to room temperature but it liquefied again when it was warmed to about 55° C.

A slurry of magnetite was prepared as described in Example 11, and it was coated with 45 g of the above described dispersant. The coated magnetite was washed, dried, and refined as described in Example 11. A total of 40 g of PX-336 was added and the heptane was evaporated in a stream of air. The resulting magnetic colloid was refined as described in Example 11, and the colloid had an apparent magnetization of 243 gauss, a density of 1.206 g/cc, and a viscosity of 3597 cp at 27° C.

EXAMPLE 14

An acid terminated poly (12-hydroxystearic acid) dispersant was prepared from 400 g of commercial grade 12-hydroxystearic acid, 80–85% pure, 44.12 g of p-anisic acid, and 88 g of xylene. The apparatus and procedure described in Example 1 was used, and 19.25 g of water was recovered. The dispersant solution solidified to a paste when it was cooled to room temperature but it became a homogeneous liquid when it was warmed to 55° C.

A slurry of magnetite was prepared, coated with 44.57 g of the above described dispersant, and refined as described in Example 11. A total of 40 g of PX-336 was added to the heptane slurry and the heptane was evaporated by heating in a stream of air. The resulting colloid was refined as described in Example 11, and it had an apparent magnetization value of 243 gauss, a density of 1.183 g/cc, and a viscosity of 4316 cp at 27° C.

EXAMPLE 15

An acid terminated poly (12-hydroxystearic acid) dispersant was prepared from 400 g of commercial grade 12-hydroxystearic acid, 80–85% purity, 39.5 g of phenylacetic acid, and 88 g of xylene. The procedure and apparatus described in Example 1 was used, and 18.5 cc of water was recovered. The dispersant solution solidified to a paste when it was cooled to room temperature, but liquefied again when it was warmed to 55° C.

A slurry of magnetite was prepared as described in Example 11, coated with 44 g of the above described dispersant, and washed, dried, and refined using the procedure described in Example 11. A total of 40 g of PX-336 was added to the heptane slurry which was then heated in a stream of air to evaporate heptane. The resulting colloid, after refining and filtering as described in Example 11, had an apparent magnetization value of 249 gauss, a density of 1.214 g/cc, and a viscosity of 1766 cp at 27° C.

EXAMPLE 16

An acid terminated poly (12-hydroxystearic acid) dispersant was prepared from 1245 g of commercial grade 12-hydroxystearic acid, 80–85% purity, 255 g of isostearic acid, and 150 g of xylene. The apparatus and procedure described in Example 1 was used.

A slurry of magnetite was prepared from 278 g of ferrous sulfate heptahydrate, 470 ml of 42° Be ferric chloride solution, and 400 ml of water by pouring this solution with vigorous stirring into a solution of 600 ml of 26° Be ammonia in 400 ml of water. The magnetite was coated using 240 g of the above described dispersant and 400 ml of heptane. An emulsion formed on stirring and it was broken by adding about 500 ml of acetone. It was washed four times with 2000 ml portions of water and dried two times with 1000 ml portions of acetone. The dried magnetite was dispersed in 3000 ml of heptane and poured into a 4000 ml beaker. The slurry was then heated in a stream of air to evaporate acetone and residual water. The slurry was then refined and filtered as described in Example 6.

The slurry was then divided into four equal portions of about 600 ml each. A quantity of 80 g of carrier liquid was added to each portion and the heptane was evaporated in a stream of air. The magnetic colloids were refined as described in Example 11.

Using butyl oleate, obtained from Witco Company as the carrier, the magnetic colloid had an apparent magnetization of 250 gauss, a density of 1.181 g/cc, and a viscosity of 281.2 cp at 27° C.

Using dioctyl azelate, obtained from C. P. Hall Co., as the carrier, the magnetic colloid had an apparent magnetization of 257 gauss, a density of 1.208 g/cc, and a viscosity of 425 cp at 27° C.

Using dioctyl adipate, obtained from C. P. Hall Co., as the carrier, the magnetic colloid had an apparent magnetization of 250 gauss, a density of 1.200 g/cc, and a viscosity of 119.4 cp at 27° C.

Using butoxyethyl oleate, obtained from C. P. Hall Co., as the carrier, the magnetic colloid had an apparent magnetization of 257 gauss, a density of 1.205 g/cc, and a viscosity of 154 cp at 27° C.

EXAMPLE 17

The superior resistance of the magnetic colloids of the present invention to gelling at elevated temperature was demonstrated by the following test.

Colloid I was prepared according to the procedure described in Example 4. Colloid II utilized erucic acid as the sole dispersant and was prepared according to the procedure described in Example 1 of U.S. Pat. No. 5,064,550. Colloid III was prepared according to the procedure described in Example 5 of U.S. Pat. No. 4,430,239. All three colloids were adjusted to an apparent magnetization value of about 250 gauss utilizing their respective carrier liquids.

Equal quantities of the three colloids, 0.48–0.52 g were placed in glass vials about 1.0 cm. in diameter and 1.5 cm in length and placed in an oven at 164° C. They were observed periodically for thickening and gelation. It was found that Colloid II which used a fatty acid as the sole dispersant thickened and gelled over a period from about 0 to 24 hours. Colloid III, which used a fatty acid as the first dispersant and a phosphate ester as the second dispersant thickened and gelled over a period from about 24 to 48 hours. Colloid I, however, which utilized an acid terminated poly (12-hydroxystearic acid) dispersant thickened and gelled over a period of from about 96 to 144 hours. This test clearly demonstrates the surprising and unexpected improved gel resistance of the magnetic colloids of this invention.

EXAMPLE 18

Examples 18 and 19 illustrate the effects of varying the molecular weight of the acid terminated poly dispersant of the invention on a variety of physical and chemical properties of a ferrofluid.

Different molecular weight poly dispersants were prepared from the raw materials shown in Table 1 utilizing the general procedures and apparatus described in Example 1.

TABLE 1

| Number of "n" in Formula I | Calculated molecular weight | Amount of technical grade 12-hydroxystearic acid (g) | Amount of isostearic acid (g) | Amount of xylene (g) |
|---|---|---|---|---|
| 0 | 566 | 88 | 58 | 10 |
| 1 | 848 | 353 | 89 | 40 |
| 2 | 1130 | 353 | 41 | 40 |
| 3 | 1412 | 353 | 0 | 40 |

EXAMPLE 19

A slurry of magnetite was prepared by adding a solution of 69.5 g of ferrous sulfate heptahydrate and 117.5 cc of 42° Be ferric chloride solution in 250 cc of water to a vigorously stirred mixture of 100 cc of water and 150 cc of 26° Be ammonia solution. The mixture was stirred for 10 minutes.

400 cc of the slurry was used for each dispersant. Varying amounts of a poly dispersant were dissolved in 300–600 cc of heptane, added into the magnetite slurry, and the mixture was stirred for 3 minutes. 600 cc of acetone was added to the mixture with stirring and the mixture was stirred for 3 minutes and left alone for 10 hours. Depending upon the poly dispersant used, each with a different molecular weight, a different process was applied.

For the case using a poly dispersant where "n" in Formula I is 0, the supernatant was removed and the mass of the coated particles at the bottom was collected into a 1000 cc beaker. The particles sticking on the wall and at the bottom of the container were rinsed with heptane to collect all the coated particles and put in the beaker. About 500 cc of heptane including heptane used for rinsing was added in the beaker and the particles were dispersed in heptane with stirring. The volume was adjusted to be 920 cc with heptane.

For the case using a poly dispersant where "n" in Formula I is 1, 2, or 3, the heptane based ferrofluid was recovered, and the volume was adjusted to be 920 cc with heptane.

460 cc of each heptane based ferrofluid was used and washed with about 900 cc of acetone, the flocked particles were redispersed in about 600 cc of heptane, and the acetone washing and heptane dispersing process was repeated one more time.

The heptane based ferrofluid was divided into two equal parts, and a specified amount of PX-336 and mixed pentaerythritol ester carrier liquids were added into the heptane based ferrofluids respectively. Heptane was removed by evaporation and the saturation magnetization of the oil based ferrofluid was adjusted with the carrier liquid to be about 200 G. Tables 2-1 and 2-2 show the physical and chemical properties of the resulting ferrofluids.

The reasons for (1) the differences in viscosities between the ferrofluids with the lowest molecular weight poly dispersant and the other ferrofluids and (2) the similarities between the viscosities of the ferrofluids with the higher molecular weight poly dispersants is not clear. However, it is believed that the larger molecular weight poly dispersants do not coat the magnetite particles as much as the lower molecular weight poly dispersants because of the limited space availability for the dispersants around the particles.

The gel times shown in Tables 2-1 and 2-2 were measured in accordance with the procedure described in Example 20 below.

TABLE 2-1*

| Number of "n" in Formula I | 0 | 1 | 2 | 3 |
|---|---|---|---|---|
| Calculated molecular weight | 566 | 848 | 1130 | 1412 |
| Amount of poly dispersant used (g) | 26 | 40 | 52 | 68 |
| Saturation Magnetization (G) | 200 | 216 | 195 | 201 |
| Viscosity at 27° C. (cP) | 168 | 570 | 410 | 413 |
| Density (g/cm3) | 1.18 | 1.20 | 1.17 | 1.17 |
| Gel time at 150° C. (hours) | 172–200 | 230–253 | 253–277 | 149–172 |
| Gel time at 130° C. (hours) | 575–608 | 608–628 | 721–744 | 520–550 |

*Carrier liquid = PX-336

TABLE 2-2*

| Number of "n" in Formula I | 0 | 1 | 2 | 3 |
|---|---|---|---|---|
| Calculated molecular weight | 566 | 848 | 1130 | 1412 |
| Amount of poly dispersant used (g) | 26 | 40 | 52 | 68 |
| Saturation Magnetization (G) | 192 | 202 | 205 | 198 |
| Viscosity at 27° C. (cP) | 84 | 237 | 217 | 202 |
| Density (g/cm3) | 1.17 | 1.18 | 1.18 | 1.17 |
| Gel time at 150° C. (hours) | 69–102 | 128–149 | 149–172 | 128–149 |
| Gel time at 130° C. (hours) | 233–253 | 341–370 | 418–427 | 341–370 |

*Carrier liquid = Mixed pentaerythritol ester. The mixed pentaerythritol ester is available, for example, from Hatco Corp. as "Hatcol 2352," and is believed to be a mixture of ester of pentaerythritol and $C_7/C_9$ acids.

EXAMPLE 20

This example illustrates the procedures used to measure gel times.

A ferrofluid was placed in a glass tube having an inside diameter of 12.9 mm, an outside diameter of 15.0 mm, and a length of 10.0 mm. A sufficient volume of ferrofluid was used so that the tube contained 3 mm of material.

The tube was then placed in a hole drilled in a first aluminum plate (110 mm×110 mm×10 mm), the hole being sized such that the tube fit snugly. The first aluminum plate was then placed on a second aluminum plate (220 mm×220 mm×20 mm) that was maintained at a constant temperature in an oven at a controlled temperature of 150°±2° C. or 130°±2° C. The second aluminum plate is kept in the oven to hold the first aluminum plate.

The tube containing the ferrofluid was periodically removed from the oven when it had cooled, and examined for signs of gel formation. A small magnet was placed at the meniscus of the fluid in the tube. When the material was no longer attracted to the portion of the magnet held above the meniscus, the fluid was considered to have gelled.

Repeated experiments utilizing the same ferrofluid composition at the same temperature showed that gel times were repeatable to within ±20%. The results are presented in Tables 2-1 and 2-2.

EXAMPLE 21

This example further illustrates the physical and chemical properties of ferrofluids using various types of carrier liquids. Ferrofluids based on various types of carrier liquids were prepared as described above in Example 19 and the physical and chemical properties are shown in Table 3.

The poly dispersant used had an "n" value in Formula I of 0, a calculated molecular weight of 566, and was prepared as described above in Example 1. All ferrofluids contained 2% of an alkyl diphenyl amine as an antioxidant.

TABLE 3

| Carrier liquid | Saturation magnetization (G) | Viscosity at 27° C. (cP) | Density (g/cm³) | Gel time at 150° C. (hours) |
|---|---|---|---|---|
| Butoxy ethyloleate | 303 | 43 | 1.21 | 102–126 |
| | 246 | 31 | Not Measured | 126–149 |
| | 199 | 24 | 1.10 | 126–149 |
| dioctyl sebacate[1] | 323 | 73 | 1.25 | 167–214 |
| | 242 | 46 | Not Measured | 190–214 |
| | 209 | 38 | 1.13 | 190–214 |
| mixed ester of trimethylol propane[2] | 311 | 108 | 1.25 | 238–284 |
| | 258 | 79 | Not Measured | 238–284 |
| | 195 | 58 | 1.14 | 238–284 |
| hindered ester of trimethylol propane[3] | 303 | 130 | 1.25 | 238–284 |
| | 249 | 95 | Not Measured | 284–312 |
| | 199 | 70 | 1.14 | 284–312 |

[1]Dioctyl sebacate is available from Hatco Corp. as "Hatcol 3110."
[2]The mixed ester of trimethylol propane is available from Hatco Corp. as "Hatcol 2925," and is believed to be a mixture of ester of trimethylol propane and $C_7/C_8/C_{10}$ acids.
[3]Hindered ester of trimethylol propane is available from Unichema International as "Priolube 3970."--

What is claimed is:

1. A magnetic colloid composition comprising a polar ester carrier liquid, magnetic particles, and a dispersant selected from the group consisting of acid terminated poly (12-hydroxystearic acid) dispersants of the Formula I:

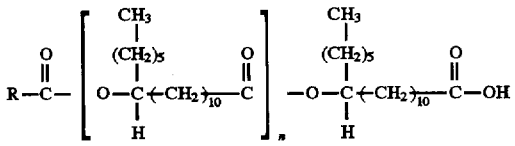

where R is selected from the group consisting of alkyls, aralkyls and aryls, substituted or unsubstituted, and n is an integer from 0 to 4, or mixtures thereof where R and n may be the same or different.

2. The magnetic colloid composition of claim 1, wherein the carrier liquid is selected from the group consisting of ester plasticizers for polymers; polyesters of saturated hydrocarbon acids; phthalates; citrate esters; trimellitate esters; esters of phthalic acid derivatives; phosphate esters; and epoxy derivatives.

3. The magnetic colloid composition of claim 2, wherein the polar carrier liquid is a trimellitate triester.

4. The magnetic colloid composition of claim 1, wherein the magnetic particles are selected from the group consisting of magnetite, gamma iron oxide, chromium dioxide, ferrites, and metallic alloys.

5. The magnetic colloid composition of claim 4, wherein the magnetic particles are magnetite.

6. The magnetic colloid composition of claim 1, wherein R is a $C_{22}$ or less substituted or unsubstituted alkyl and n is an integer from 0 to 3.

7. The magnetic colloid composition of claim 6, wherein R is a $C_{17}$ or less linear or branched alkyl and n is an integer from 0 to 2.

8. The magnetic colloid composition of claim 1, wherein the dispersant is a poly (12-hydroxystearic acid) dispersant terminated with isostearic acid.

9. The magnetic colloid composition of claim 1 further comprising an antioxidant.

10. The magnetic colloid composition of claim 1 further comprising a quarternary ammonium salt.

11. The magnetic colloid composition of claim 1 further comprising an antioxidant and a quarternary ammonium salt.

12. A stable magnetic colloid composition consisting essentially of a polar ester carrier liquid, magnetic particles, and a dispersant selected from the group consisting of acid terminated poly (12-hydroxystearic acid) dispersants of the Formula I:

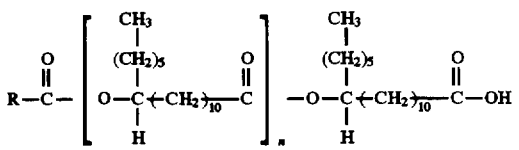

where R is selected from the group consisting of alkyls, aralkyls and aryls, substituted or unsubstituted, and n is an integer from 0 to 4, or mixtures thereof where R and n may be the same or different.

13. The magnetic colloid composition of claim 12, wherein the carrier liquid is selected from the group consisting of ester plasticizers for polymers; polyesters of saturated hydrocarbon acids; phthalates; citrate esters; trimellitate esters; esters of phthalic acid derivatives; phosphate esters; and epoxy derivatives.

14. The magnetic colloid composition of claim 13, wherein the polar carrier liquid is trimellitate triester.

15. The magnetic colloid composition of claim 12, wherein the magnetic particles are selected from the group consisting of magnetite, gamma iron oxide, chromium dioxide, ferrites, and metallic alloys.

16. The magnetic colloid composition of claim 15 wherein the magnetic particles are magnetite.

17. The magnetic colloid composition of claim 12, wherein R is a $C_{22}$ or less substituted or unsubstituted alkyl and n is an integer from 0 to 3.

18. The magnetic colloid composition of claim 17, wherein R is a $C_{17}$ or less linear or branched alkyl and n is an integer from 0 to 2.

19. The magnetic colloid composition of claim 12, wherein the dispersant is a poly (12-hydroxystearic acid) dispersant terminated with isostearic acid.

20. The magnetic colloid composition of claim 12 further consisting essentially of an antioxidant.

21. The magnetic colloid composition of claim 12 further consisting essentially of a quarternary ammonium salt.

22. The magnetic colloid composition of claim 12 further consisting essentially of an antioxidant and a quaternary ammonium salt.

23. A stable magnetic colloid composition comprising an isostearic acid terminated poly (12-hydroxystearic acid), a trimellitate ester liquid, and magnetite.

24. The magnetic colloid composition of claim 1, wherein R is a substituted aryl.

25. The magnetic colloid composition of claim 1, wherein R is a substituted aralkyl.

26. The magnetic colloid composition of claim 24, wherein the dispersant is a poly (12-hydroxystearic acid) dispersant terminated with p-toluic acid.

27. The magnetic colloid composition of claim 24, wherein the dispersant is a poly (12-hydroxystearic acid) dispersant terminated with 2,4-dichlorobenzoic acid.

28. The magnetic colloid composition of claim 24, wherein the dispersant is a poly (12-hydroxystearic acid) dispersant terminated with p-tert. butyl benzoic acid.

29. The magnetic colloid composition of claim 25, wherein the dispersant is a poly (12-hydroxystearic acid) dispersant terminated with phenylacetic acid.

30. The magnetic colloid composition of claim 2, wherein the carrier liquid is selected from the group consisting of butyl oleate, dioctyl azelate, dioctyl adipate, butoxyethyl oleate, trimellitate triester, dioctyl sebacate, mixed pentaerythritol esters, hindered esters of trimethylol propane, and mixed esters of trimethylol propane.

31. The magnetic colloid composition of claim 12, wherein R is a substituted aryl.

32. The magnetic colloid composition of claim 12, wherein R is a substituted aralkyl.

33. The magnetic colloid composition of claim 31, wherein the dispersant is a poly (12-hydroxystearic acid) dispersant terminated with p-toluic acid.

34. The magnetic colloid composition of claim 31, wherein the dispersant is a poly (12-hydroxystearic acid) dispersant terminated with 2,4-dichlorobenzoic acid.

35. The magnetic colloid composition of claim 31, wherein the dispersant is a poly (12-hydroxystearic acid) dispersant terminated with p-tert. butyl benzoic acid.

36. The magnetic colloid composition of claim 32, wherein the dispersant is a poly (12-hydroxystearic acid) dispersant terminated with phenylacetic acid.

37. The magnetic colloid composition of claim 13, wherein the carrier liquid is selected from the group consisting of butyl oleate, dioctyl azelate, dioctyl adipate, butoxyethyl oleate, trimellitate triester, dioctyl sebacate, mixed pentaerythritol esters, hindered esters of trimethylol propane, and mixed esters of trimethylol propane.

38. A stable magnetic colloid composition comprising:

(1) a polar ester carrier liquid selected from the group consisting of trimellitate triester, butyl oleate, dioctyl azelate, dioctyl adipate, butoxyethyl oleate, dioctyl sebacate, mixed pentaerythritol esters, hindered esters of trimethylol propane, and mixed esters of trimethylol propane;

(2) magnetic particles selected from the group consisting of magnetite, gamma iron oxide, chromium dioxide, ferrites, and metallic alloys; and (3) a dispersant or mixtures thereof selected from the group consisting of isostearic acid terminated poly (12-hydroxystearic acid), p-toluic acid terminated poly (12-hydroxystearic acid), 2,4-dichlorobenzoic acid terminated poly (12-hydroxystearic acid), p-tert. butyl benzoic acid terminated poly (12-hydroxystearic acid), and phenylacetic acid terminated poly (12-hydroxystearic acid).

39. A magnetic colloid composition comprising:

a polar ester carrier liquid, magnetic particles, and a dispersant or mixtures thereof, wherein the dispersant is an acid terminated poly (12-hydroxystearic acid) having a molecular weight of about 500 to 1500.

40. The magnetic colloid composition of claim 39, wherein the viscosity of the composition measured at 27° C. is about 80 to 570 cP.

41. The magnetic colloid composition of claim 39, wherein the carrier liquid is selected from the group consisting of trimellitate esters and mixed pentaerythritol esters.

42. The magnetic colloid composition of claim 39, wherein the composition has a gel time measured at 130° C. of about 230 to 750 hours.

43. The magnetic colloid composition of claim 39, wherein the composition has a gel time measured at 150° C. of about 70 to 280 hours.

44. The magnetic colloid composition of claim 1, wherein the carrier liquid is selected from the group consisting of butoxyethyl oleate, dioctyl sebacate, mixed pentaerythritol esters, hindered esters of trimethylol propane, mixed esters of trimethylol propane, trimellitate triester, butyl oleate, dioctyl azelate, and dioctyl adipate.

45. The magnetic colloid composition of claim 12, wherein the carrier liquid is selected from the group consisting of butoxyethyl oleate, dioctyl sebacate, mixed pentaerythritol esters, hindered esters of trimethylol propane, mixed esters of trimethylol propane, trimellitate triester, butyl oleate, dioctyl azelate, and dioctyl adipate.

* * * * *